US010172508B2

(12) United States Patent
Aras et al.

(10) Patent No.: US 10,172,508 B2
(45) Date of Patent: Jan. 8, 2019

(54) DISHWASHER COMPRISING A DETERGENT DISPENSER

(71) Applicant: ARCELIK ANONIM SIRKETI, Istanbul (TR)

(72) Inventors: Nasir Efe Aras, Istanbul (TR); Orhan Atabey, Istanbul (TR); Nurgul Gokdere, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 107 days.

(21) Appl. No.: 14/404,728

(22) PCT Filed: May 29, 2013

(86) PCT No.: PCT/EP2013/061079

§ 371 (c)(1),
(2) Date: Dec. 1, 2014

(87) PCT Pub. No.: WO2013/178686

PCT Pub. Date: Dec. 5, 2013

(65) Prior Publication Data

US 2015/0122299 A1 May 7, 2015

(30) Foreign Application Priority Data

May 30, 2012 (TR) ..... a 2012 06344

(51) Int. Cl.

| | |
|---|---|
| ***A47L 15/16*** | (2006.01) |
| ***A47L 15/44*** | (2006.01) |
| ***A47L 15/42*** | (2006.01) |

(52) U.S. Cl.
CPC ..... *A47L 15/4409* (2013.01); *A47L 15/16* (2013.01); *A47L 15/4217* (2013.01);
(Continued)

(58) Field of Classification Search
None
See application file for complete search history.

(56) References Cited

U.S. PATENT DOCUMENTS 2,630,813 A * 3/1953 Murdoch ..... A47L 15/16 134/175
3,386,454 A * 6/1968 Kendt ..... A47L 15/4229 134/108
(Continued)

FOREIGN PATENT DOCUMENTS

CA 1060213 A 8/1979
CH 403193 A 11/1965
(Continued)

OTHER PUBLICATIONS

International search report and written opinion, dated Nov. 20, 2013, of International Application No. PCT/EP2013/061079; 9 pgs.

*Primary Examiner* — Jason Y Ko
*Assistant Examiner* — Cristi J Tate-Sims
(74) *Attorney, Agent, or Firm* — Kilpatrick Townsend & Stockton LLP

(57) ABSTRACT

The present invention relates to a dishwasher (1) comprising a tub (3) having more than one side wall (2), wherein the washing process is performed, a door (4) providing access into the tub (3) and a detergent dispenser (5) disposed on the door (4) wherein the chemical substances like detergent, softener and rinse aid are placed.

15 Claims, 6 Drawing Sheets

Figure 1:
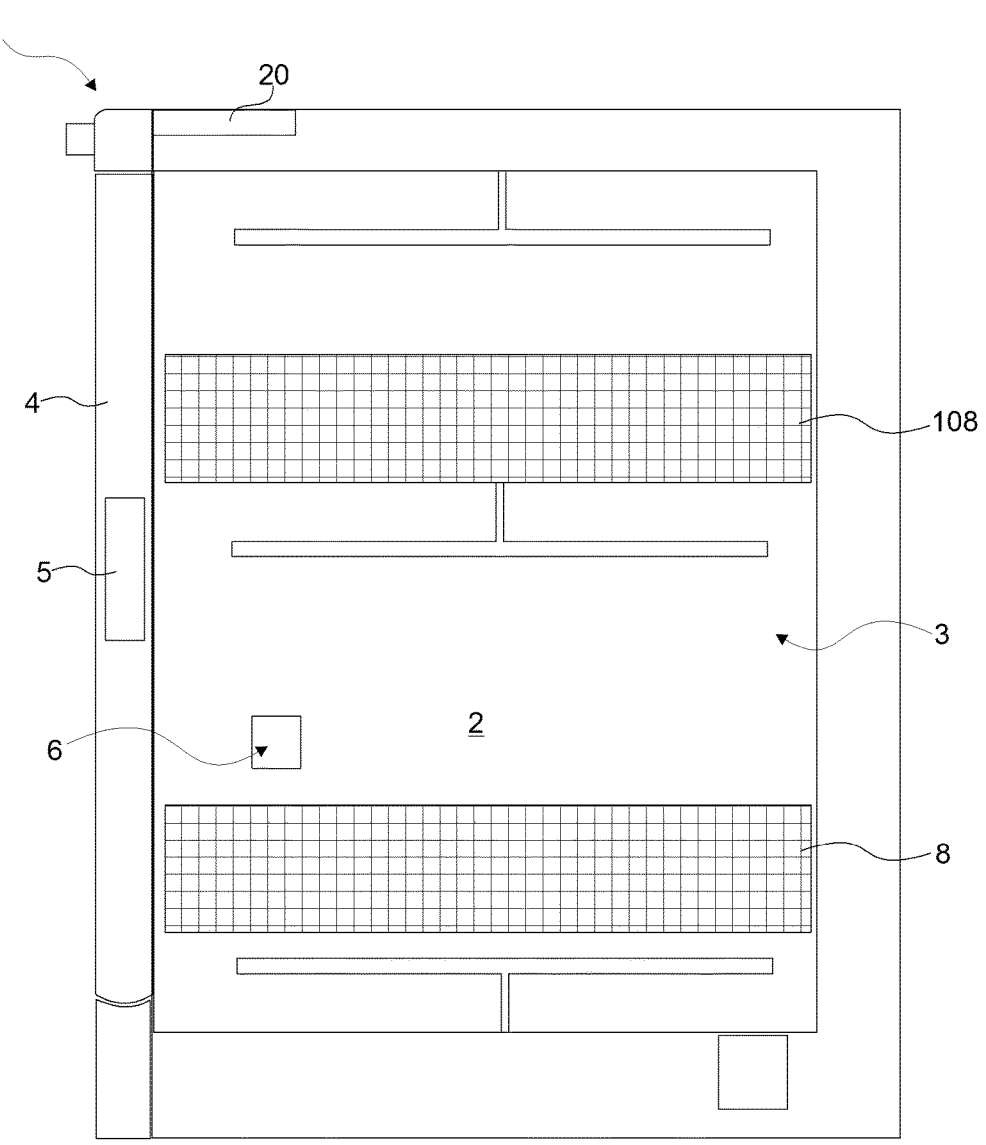

(52) U.S. Cl.
CPC ..... *A47L 15/4229* (2013.01); *A47L 2401/11* (2013.01); *A47L 2501/01* (2013.01); *A47L 2501/18* (2013.01)

(56) References Cited

U.S. PATENT DOCUMENTS

| | | | | |
|---|---|---|---|---|
| 5,759,501 | A | 6/1998 | Livingston et al. | |
| 6,869,029 | B2 * | 3/2005 | Ochoa, Sr. | A47L 15/508 134/176 |
| 7,523,757 | B2 * | 4/2009 | Cantrell | A47L 15/0092 134/25.2 |
| 9,044,134 | B2 * | 6/2015 | Park | A47L 15/428 |
| 2003/0041887 | A1 * | 3/2003 | Inch | A47L 15/0092 134/186 |
| 2004/0250837 | A1 * | 12/2004 | Watson | A47L 15/16 134/25.2 |
| 2005/0178406 | A1 * | 8/2005 | Kang | A47L 15/4229 134/18 |
| 2008/0011339 | A1 * | 1/2008 | Ryu | A47L 15/4217 134/56 D |
| 2009/0101182 | A1 * | 4/2009 | Buesing | A47L 15/16 134/95.3 |
| 2011/0030742 | A1 * | 2/2011 | Dalsing | A47L 15/16 134/198 |
| 2011/0247663 | A1 | 10/2011 | Gadini et al. | |
| 2012/0138101 | A1 * | 6/2012 | Francisco | A47L 15/0028 134/25.2 |

FOREIGN PATENT DOCUMENTS

| | | | | |
|---|---|---|---|---|
| DE | 8516941 | U1 | 10/1986 | |
| DE | 3620900 | A1 | 12/1987 | |
| DE | 20311432 | U1 | 12/2003 | |
| EP | 1479813 | A1 | 11/2004 | |
| EP | 1847209 | A1 | 10/2007 | |
| EP | 1929920 | A1 * | 6/2008 | A47L 15/16 |
| EP | 1935319 | A2 | 6/2008 | |
| EP | 2387936 | A1 | 11/2011 | |
| GB | 867821 | A | 5/1961 | |
| GB | 2417412 | A | 3/2006 | |
| JP | H07250798 | A | 10/1995 | |
| WO | 9307798 | A1 | 4/1993 | |
| WO | 2006069827 | A1 | 7/2006 | |

* cited by examiner

DISHWASHER COMPRISING A DETERGENT DISPENSER

The present invention relates to a dishwasher comprising a detergent dispenser.

In dishwashers, detergent dispensers that are generally mounted on the inner side of the door are used. A chamber, wherein the water in the tub is collected, is situated at the lower side of the tub wherein the washing process is performed. In the state of the art, by means of a pump the water in the chamber is directed to the spray arms positioned one above the other inside the tub. Some time after the start of the washing process, the cover of the detergent dispenser is opened and the water circulated inside the tub impacts the opened detergent dispenser thereby providing the detergent placed in the detergent dispenser to be mixed with water and to be delivered into the tub. Thus, the dishes placed onto the racks, that are located one over the other inside the tub, are cleaned. However, due to the position of the door and the racks, the cover of the detergent dispenser opens with a limited angle. Therefore, the whole of the delivered water does not contact with the detergent contained inside the detergent dispenser and causes detergent residue to remain inside the detergent dispenser. The detergent inside the detergent dispenser not being entirely flushed causes decrease in the washing performance. Furthermore, due to the detergent residue remaining in the detergent dispenser, the detergent mixes with water in the rinsing steps and prevents rinsing from being performed in an effective manner.

In the state of the art European Patent Application No. EP1929920, a dishwasher is described having a first wall whereon the detergent dispenser is arranged, a second wall whereon the water inlet is arranged and a third wall that provides the water passing from the water inlet to be impacted and directed towards the detergent dispenser.

The aim of the present invention is the realization of a dishwasher wherein the detergent placed into the detergent dispenser is provided to be flushed effectively.

The dishwasher realized in order to attain the aim of the present invention, explicated in the first claim and the respective claims thereof, comprises at least one water inlet disposed on the side wall thereof, which provides the water coming from the mains to pass directly into the tub and at least one nozzle that provides the mains water coming into the water inlet and moving forward to be sprayed towards the detergent dispenser. The water received from the mains flows directly to the water inlet. The mains pressure provides the water supplied from the mains to be delivered to the water inlet. An additional pumping means is not provided for delivering the mains water to the water inlet. The mains water passing from the water inlet is directed towards the detergent dispenser directly by means of the nozzle and the entire detergent contained inside the detergent dispenser is provided to be mixed with the mains water and delivered into the tub. Thus, the entire detergent placed into the detergent dispenser is provided to be flushed from inside the detergent dispenser with the present mains pressure, without requiring an additional pumping means.

In an embodiment of the present invention, the water inlet is disposed at the section of the side wall near the detergent dispenser. Thus, it is provided that no object is located on the flow path of the mains water, directed towards the detergent dispenser from the nozzle in front of the water inlet, that reduces its speed or prevent it from reaching the detergent dispenser. The water is provided to contact the detergent in a shorter period of time.

In an embodiment of the present invention, the dishwasher comprises at least two racks located one above the other inside the tub and whereon the items to be washed are placed and the water inlet arranged between the upper rack and the lower rack in the vertical axis. Thus, the nozzle is prevented from remaining behind the racks.

In an embodiment of the present invention, the nozzle comprises a hub wherein the water received from the water inlet is stored, an inlet port arranged on the hub, on the side of the hub facing the water inlet, an outlet port arranged on the hub, on the side facing inside of the tub, and a channel extending between the inlet port and the outlet port, that delivers the mains water stored inside the hub to the detergent dispenser.

In an embodiment of the present invention, the hub is dome-shaped. The inlet port is situated at the side of the hub ceiling. The mains water received from the inlet port situated inside the hub, at the portion wherein water is stored, flows through the channel by means of the mains pressure and entirely leaves the hub by means of the outlet port situated at the outer portion of the hub and is directed towards the detergent dispenser.

In an embodiment of the present invention, the outlet port faces the detergent dispenser. Thus, the water leaving from the outlet port is provided to be sprayed directly over the detergent contained inside the detergent dispenser.

In an embodiment of the present invention, the cross-sectional area of the inlet port is greater than the cross-sectional area of the outlet port. Thus, the mains water moves inside the channel from a greater cross-sectional area towards a smaller cross-sectional area and thereby its pressure is provided to be increased.

The channel extends from the inlet port towards the outlet port by getting narrower. Thus, the water moving towards the outlet port is provided to be delivered to the detergent dispenser in a pressurized state.

In an embodiment of the present invention, the dishwasher comprises a retainer that provides the nozzle to be fixed to the side wall. The side wall remains between the nozzle and the retainer. The nozzle and the retainer are secured to one another by bayonet connection. Furthermore, a sealing element is situated between the nozzle and the retainer. The sealing element provides leak-proofing between the nozzle and the retainer.

In an embodiment of the present invention, the dishwasher comprises a water receptacle having a water counter that allows the amount of water received inside from the mains to be measured and a hose that enables the water leaving the water receptacle to be conveyed to the water inlet. The water supplied from the mains fills into the water receptacle and the amount of water received into the water receptacle from the mains is monitored by means of the water counter.

In an embodiment of the present invention, the dishwasher comprises a water softening unit which provides the water to be softened, a chamber wherein the water in the tub is collected and a valve that delivers the water leaving the water softening unit to the nozzle or the chamber.

In an embodiment of the present invention, the dishwasher comprises a control unit that regulates the operation of the valve depending on the hardness of water. The control unit regulates delivery of water to the chamber and/or the nozzle.

In an embodiment of the present invention, the control unit provides the water leaving the water softening unit to be delivered to the chamber during the regeneration process. The water is provided to be delivered to the chamber when the salt concentration of water is high and to the nozzle when the salt concentration of water is low by means of the valve. Consequently, the salt water generated during the regeneration process is prevented from being delivered to the tub.

In an embodiment of the present invention, the control unit provides the soft water that is passed through the water softening unit to be delivered to the nozzle by means of the valve before and/or after the regeneration process.

In an embodiment of the present invention, the valve is a three-way control valve. One end of the valve is connected to the water softening unit, one end to the chamber and the other end to the nozzle. The valve adjusts the amount of water passing therethrough and changes its direction. The control valve directs the flow of water passing through the water softening unit to the nozzle and/or the chamber in accordance with the determined control function.

By means of the present invention, a dishwasher is realized having a nozzle that delivers the mains water without losing its pressure to the detergent dispenser and provides the mains water to contact the detergent contained in the detergent dispenser. By means of the water inlet, water is received from the mains directly into the nozzle situated on the side wall of the dishwasher, and the received mains water is directed onto the detergent dispenser. Consequently, the mains water directly mixes with the detergent contained in the detergent dispenser and the detergent is provided to be delivered into the tub.

The model embodiments relating to the dishwasher realized in order to attain the aim of the present invention are illustrated in the attached figures, where:

FIG. 1—is the schematic view of a dishwasher.

Figure 2:
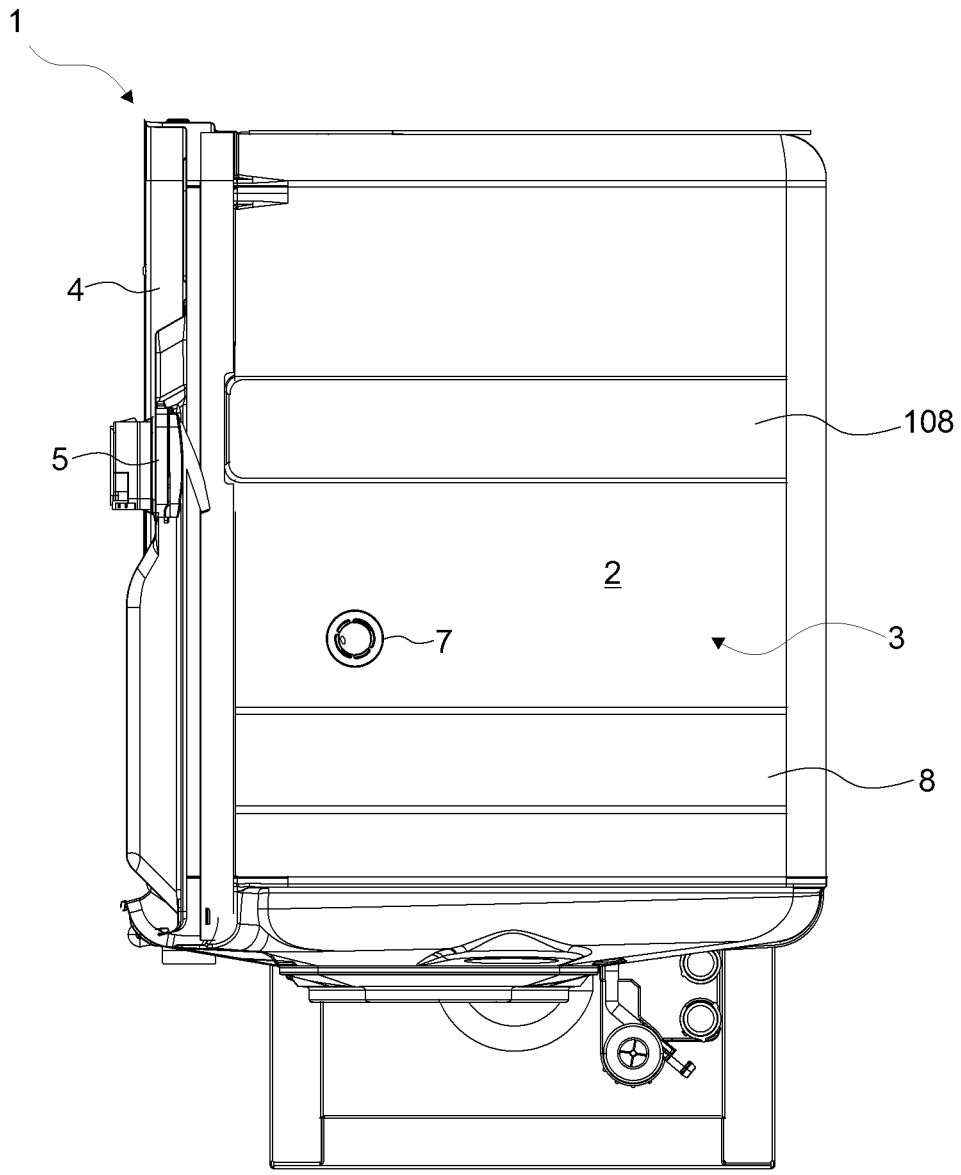

FIG. 2—is the sideways view of the dishwasher.

Figure 3:
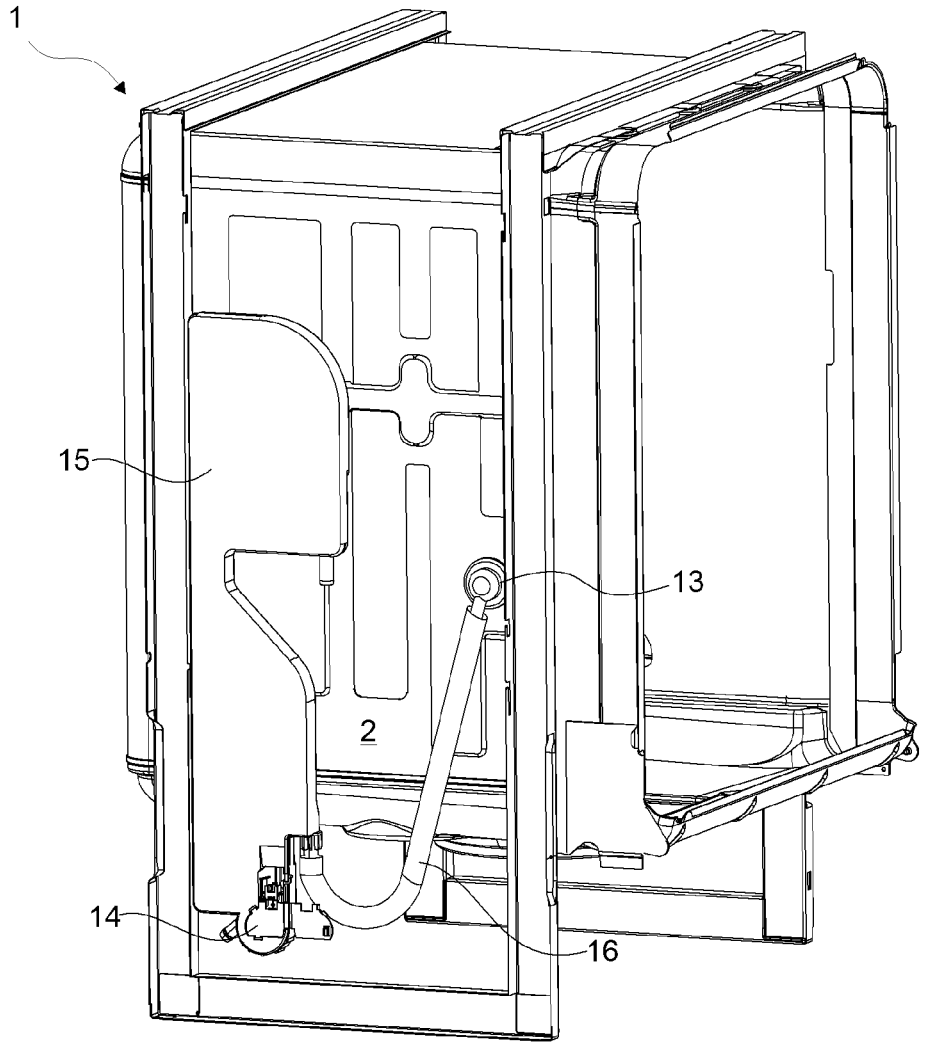

FIG. 3—is the perspective view of the dishwasher having the water receptacle, the hose and the nozzle in an embodiment of the present invention.

Figure 4:
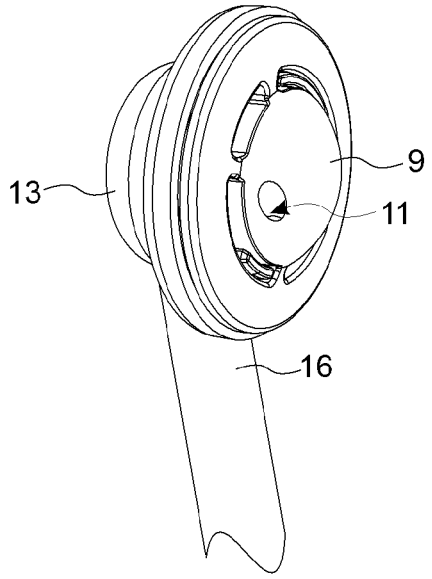

FIG. 4—is the perspective view of the nozzle, the hose and the retainer.

Figure 5:
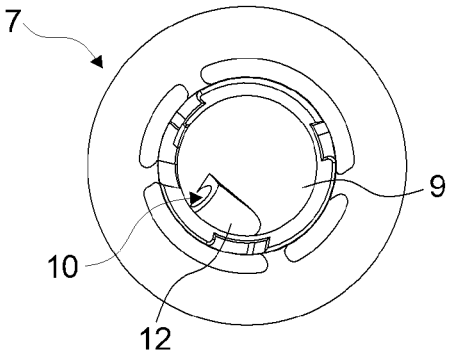

FIG. 5—is the rear view of the nozzle.

Figure 6:
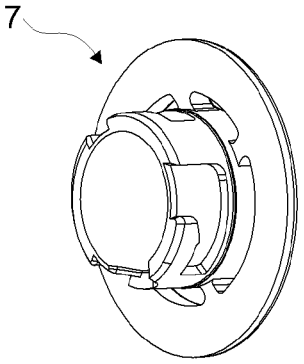

FIG. 6—is the rear perspective view of the nozzle.

Figure 7:
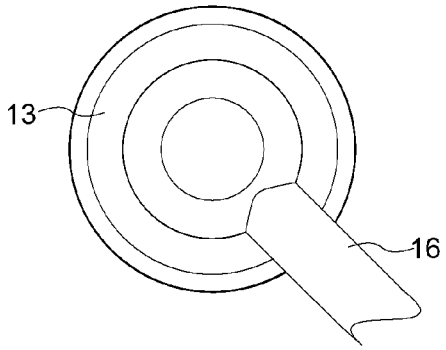

FIG. 7—is the rear view of the retainer and the hose.

Figure 8:
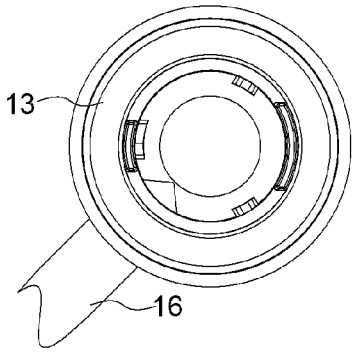

FIG. 8—is the front view of the retainer and the hose.

Figure 9:
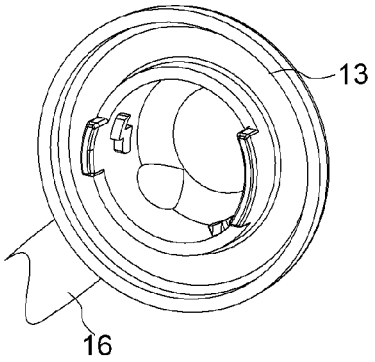

FIG. 9—is the front perspective view of the retainer and the hose.

Figure 10:
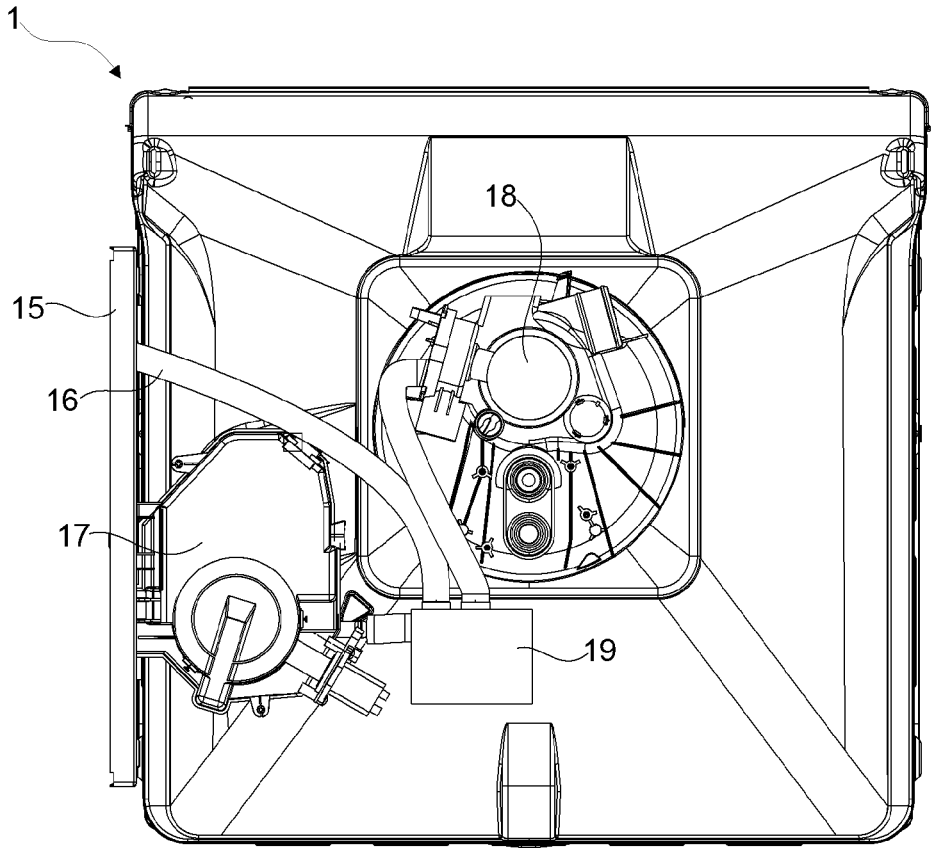

FIG. 10—is the top view of the dishwasher having the water receptacle, the water softening unit, the valve, the hose and the chamber in an embodiment of the present invention.

The elements illustrated in the figures are numbered as follows:

1. Dishwasher
2. Side wall
3. Tub
4. Door
5. Detergent dispenser
6. Water inlet
7. Nozzle
8. 108 Rack
9. Hub
10. Inlet port
11. Outlet port
12. Channel
13. Retainer
14. Water counter
15. Water receptacle
16. Hose
17. Water softening unit
18. Chamber
19. Valve
20. Control unit The dishwasher (1) comprises a tub (3) having more than one side wall (2), wherein the washing process is performed, a door (4) providing access into the tub (3) and a detergent dispenser (5) disposed on the door (4) wherein the chemical substances like detergent, softener and rinse aid are placed. The user accesses into the tub (3) by means of the door (4) and places the items to be washed inside the tub (3).

The dishwasher (1) furthermore comprises at least one water inlet (6) arranged on the side wall (2), which provides the water received from the mains to pass into the tub (3) directly with the effect of the mains pressure and a nozzle (7) mounted to the water inlet (6), which directs the water received from the water inlet (6) towards the detergent dispenser (5). The nozzle (7) is mounted to the front of the water inlet (6). The mains water reaches the water inlet (6) with almost the same pressure as supplied by the mains and is delivered directly onto the detergent dispenser (5) by means of the nozzle (7). Almost the entire amount of the detergent contained in the detergent dispenser (5) is provided to be delivered into the tub (3) by mixing with the mains water. Consequently, almost the entire amount of the detergent is provided to be flushed from the detergent dispenser (5) thereby preventing detergent residue from remaining in the detergent dispenser (5). The dishes are provided to be washed and rinsed effectively (FIG. 1, FIG. 2).

In an embodiment of the present invention, the water inlet (6) is situated on the front side of the side wall (2) facing the detergent dispenser (5). Thus, the mains water is provided to be sprayed onto the detergent dispenser (5) without deviating by disposing the nozzle (7) at the nearest point to the detergent dispenser (5). It is provided that no obstruction is situated on the flow path of the mains water while the mains water leaving the nozzle (7) is sprayed onto the detergent dispenser (5). Furthermore, the mains water is provided to be delivered to the detergent dispenser (5) without mixing with dirt etc. (FIG. 2).

In an embodiment of the present invention, the dishwasher (1) comprises at least two racks (8, 108) disposed one above the other inside the tub (3) and whereon the items to be washed are placed and the water inlet (6) arranged on the side wall (2) between the upper rack (8) and the lower rack (108). Thus, the nozzle (7) is prevented from remaining behind the items situated in the rack (8, 108) (FIG. 2).

In an embodiment of the present invention, the nozzle (7) comprises a hub (9) wherein the water received from the water inlet (6) is collected, an inlet port (10) disposed on the hub (9), on the side of the hub (9) facing the water inlet (6), an outlet port (11) situated on the side of the hub (9) facing into the tub (3) and a channel (12) extending between the inlet port (10) and the outlet port (11) and which directs the mains water collected inside the hub (9) towards the detergent dispenser (5). The hub (9) serves both as a dent that allows water coming from the mains to be stored and also as a protector that prevents the rack (8, 108) and/or objects from impacting the front of the outlet port (11). The water received from the mains is collected inside the hub (9) and enters the channel (12) by means of the inlet port (10). The water passing through the channel (12) is directed to the detergent dispenser (5) by means of the outlet port (11). The detergent contained in the detergent dispenser (5) mixes with the water leaving the outlet port (11) and the detergent is flushed from inside the detergent dispenser (5) to be delivered to the tub (3) (FIG. 4, FIG. 5, FIG. 6).

In an embodiment of the present invention, the hub (9) is shaped almost as a hemisphere. Thus, the hub (9) forms a vortex in the mains water thereby providing it to move forward in a more pressurized state and to be discharged from the outlet port (11). The channel (12) is arranged on the inner side of the hub (9). The front of the outlet port (11) is prevented from being covered thanks to the hub (9) that protrudes towards inside the tub (3) (FIG. 4).

In an embodiment of the present invention, the outlet port (11) faces the detergent dispenser (5). Consequently, the mains water is provided to be sprayed onto the detergent dispenser (5) from the nearest distance. The front side of the outlet port (11) is prevented from being covered and the outlet port (11) from being damaged by means of the hub (9).

In an embodiment of the present invention, the cross-sectional area of the outlet port (11) is smaller than the cross-sectional area of the inlet port (10). The mains water received from the water inlet (6) with the mains pressure fills into the hub (9) and passes through the inlet port (10). The pressure of the mains water is provided to be increased by means of the cross-sectional area of the outlet port (11) being smaller than that of the inlet port (10). Thus, the effectiveness of the mains water in flushing detergent from inside the detergent dispenser (5) is increased.

The channel (12) extends from the inlet port (10) towards the outlet port (11) by getting narrower. Thus, pressure of the mains water is provided to be increased while moving forward inside the channel (12) from a wider diameter to a narrower diameter and to leave the channel (12) with a higher pressure (FIG. 5).

In an embodiment of the present invention, the dishwasher (1) comprises a retainer (13) that provides the nozzle (7) to be mounted to the water inlet (6). The side wall (2) remains between the nozzle (7) and the water inlet (6). Thus, the nozzle (7), fixed by bayonet connection to the retainer (13), is prevented from being dislodged from the side wall (2) or from sliding off its location. Furthermore a sealing element is situated between the nozzle (7) and the retainer (13). The sealing element provides leak-proofing between the nozzle (7) and the retainer (13) while the mains water is delivered from the water inlet (6) to the nozzle (7) (FIG. 7, FIG. 8, FIG. 9).

In an embodiment of the present invention, the dishwasher (1) comprises a water receptacle (15) having a water counter (14) that enables the amount of water received therein from the mains to be measured and a hose (16) that allows the water leaving the water receptacle (15) to be conveyed to the water inlet (6). The amount of water received from the mains is determined by the water counter (14) and the amount of water received into the dishwasher (1) during the washing is kept under control (FIG. 3, FIG. 10).

In an embodiment of the present invention, the dishwasher (1) comprises a water softening unit (17) that provides the softening of the water, a chamber (18) wherein the water circulating inside the tub (3) during the washing is collected and a valve (19) that provides the delivery of the water leaving the water softening unit (17) to the nozzle (7) and/or the chamber (18). The amount of water received into the dishwasher (1) is determined by means of the water counter (14) located inside the water receptacle (15). The water received from the mains is delivered to the water softening unit (17) by passing through the water receptacle (15). The mains water is softened by means of the resin in the salt container while passing through the water softening unit (17). After a couple of washings, the resin, water softening capacity of which decreases, is regenerated by being mixed with salt water and its water softening capacity is increased. Spraying the salt water generated after the regeneration process directly into the tub (3) causes the surface of the tub (3) to rust. Therefore, during and/or just after the regeneration process, the salt water is delivered to the chamber (18) by means of the valve (19) and the salt water is prevented from being directly delivered into the tub (3) (FIG. 10).

In an embodiment of the present invention, the dishwasher (1) comprises a control unit (20) that controls the operation of the valve (19) depending on the hardness of water leaving the water softening unit (17).

In an embodiment of the present invention, the control unit (20) provides the water leaving the water softening unit (17) by means of the valve (19) to be delivered to the chamber (18) by means of the valve (19). The salt water discharged from the water softening unit (17) during the regeneration process is prevented from being delivered to the nozzle (7) by means of the control unit (20) (FIG. 1).

In an embodiment of the present invention, the control unit (20) provides the soft water passed through the water softening unit (17) before and/or after the regeneration process to be delivered to the nozzle (7) by means of the valve (19).

In an embodiment of the present invention, the valve (19) is a three-way control valve (19), with one end connected to the water softening unit (17), one end to the chamber (18) and the other end to the nozzle (7). The water leaving the water softening unit (17) is directed to the nozzle (7) or the chamber (18) by means of the valve (19) (FIG. 10).

By means of the present invention, a dishwasher (1) is realized having the nozzle (7) that enables the mains water to be directed to the detergent dispenser (5) by benefiting from the mains pressure. Thus, the mains water is provided to be sprayed onto the detergent dispenser (5) in a pressurized manner and to flush the detergent contained in the detergent dispenser (5) completely.

It is to be understood that the present invention is not limited to the embodiments disclosed above and a person skilled in the art can easily introduce different embodiments. These should be considered within the scope of the protection postulated by the claims of the present invention.

The invention claimed is:

1. A dishwasher (1) comprising:

a tub (3) having more than one side wall (2), wherein a washing process is performed in the tub (3), a door (4) providing access into the tub (3), a detergent dispenser (5) disposed on the door (4) wherein chemical substances like detergent, softener and rinse aid are placed, at least one water inlet (6) is arranged on the side wall (2) and provides water received from a main water source to directly pass into the tub (3) with the effect of pressure of the main water source, a nozzle (7) mounted to the water inlet (6) and directing the water received from the water inlet (6) towards the detergent dispenser (5), wherein the nozzle (7) is positioned on the side wall of the tub, the nozzle having a first portion protruding toward an exterior of the tub (3) and a second portion protruding toward an interior of the tub, wherein the nozzle comprises a hub protruding toward the side of the tub, wherein the water received from the water inlet is collected in the hub, and a retainer (13) coupled to the nozzle (7) to mount the nozzle to the water inlet (6).

2. A dishwasher (1) as in claim 1, wherein the water inlet (6) is situated on the front side of the side wall (2) facing the detergent dispenser (5).

3. A dishwasher (1) as in claim 1, wherein at least two racks (8, 108) are disposed one above the other inside the tub (3) and wherein items to be washed are placed and the water inlet (6) arranged on the side wall (2) between the upper rack (8) and the lower rack (108).

4. A dishwasher (1) as in claim 1, wherein an inlet port (10) is disposed on the hub (9), on the side of the hub (9) facing the water inlet (6), an outlet port (11) is situated on the side of the hub (9) facing into the tub (3), and a channel (12) extends between the inlet port (10) and the outlet port (11) and directs the water from the main water source collected inside the hub (9) towards the detergent dispenser (5).

5. A dishwasher (1) as in claim 4, wherein the hub is a hemispherical hub (9).

6. A dishwasher (1) as in claim 4, wherein the outlet port (11) faces the detergent dispenser (5).

7. A dishwasher (1) as in claim 4, wherein a cross-sectional area of the outlet port (11) is smaller than a cross-sectional area of the inlet port (10).

8. A dishwasher (1) as in claim 1, further comprising a water receptacle (15) having a water counter (14) that enables the amount of water received therein from the main water source to be measured and a hose (16) that allows the water leaving the water receptacle (15) to be conveyed to the water inlet (6).

9. A dishwasher (1) as claim 1, further comprising a water softening unit (17) that provides softening of the water, at least one chamber (18) wherein the water circulating inside the tub (3) during the washing is collected and a valve (19) that provides delivery of the water leaving the water softening unit (17) to the nozzle (7) and/or the chamber (18).

10. A dishwasher (1) as in claim 9, further comprising a control unit (20) that controls the operation of the valve (19) depending on a hardness of the water leaving the water softening unit (17).

11. A dishwasher (1) as in claim 9, wherein the control unit (20) provides the water leaving the water softening unit (17) during a regeneration process to be delivered to the chamber (18) by means of the valve (19).

12. A dishwasher (1) as in claim 9, wherein the control unit (20) provides soft water leaving the water softening unit (17) before and/or after a regeneration process to be delivered to the nozzle (7) by means of the valve (19).

13. A dishwasher (1) as in claim 9, further comprising a three-way control valve (19) having a first end, a second end, and a third end, wherein the first end is connected to the water softening unit (17), wherein the second end is connected to the chamber (18), and wherein the third end is connected to the nozzle (7).

14. A dishwasher (1) as in claim 1, wherein the water inlet and the nozzle are positioned on the side wall so as to provide an unobstructed path between the water inlet and the detergent dispenser for the water entering the tub.

15. A dishwasher (1) comprising:

a tub (3) having more than one side wall (2), wherein a washing process is performed in the tub (3), a door (4) providing access into the tub (3), a detergent dispenser (5) disposed on the door (4), wherein chemical substances like detergent, softener and rinse aid are placed, a water inlet (6) arranged on a first surface of the side wall (2) facing the detergent dispenser, and a nozzle (7) mounted to the water inlet (6) by being positioned on a second surface opposite from the first surface of the side wall, such that the side wall remains between the nozzle and the water inlet, wherein the nozzle comprises a hub protruding toward the side of the tub, wherein the water received from the water inlet is collected in the hub, wherein the water inlet provides water received from a main water source to pass directly into the tub (3) with the effect of pressure of the main water source and the nozzle (7), wherein the nozzle directs the water received from the water inlet (6) towards the detergent dispenser (5).

* * * * *